US007484303B1

(12) United States Patent
Henry

(10) Patent No.: US 7,484,303 B1
(45) Date of Patent: Feb. 3, 2009

(54) ADJUSTABLE ARCHERY BOW SIGHT MOUNT

(76) Inventor: Donald J. Henry, Box 28, Route 220, New Albany, PA (US) 18833

( * ) Notice: Subject to any disclaimer, the term of this patent is extended or adjusted under 35 U.S.C. 154(b) by 0 days.

(21) Appl. No.: 11/614,146

(22) Filed: Dec. 21, 2006

Related U.S. Application Data

(60) Provisional application No. 60/597,891, filed on Dec. 22, 2005.

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | | | |
|---|---|---|---|---|---|
| 3,477,130 | A * | 11/1969 | Egan | 33/265 |
| 3,674,002 | A * | 7/1972 | Diamond, Sr. | 124/87 |
| 4,020,560 | A * | 5/1977 | Heck | 33/265 |
| 4,543,728 | A * | 10/1985 | Kowalski | 33/265 |
| 4,669,196 | A * | 6/1987 | Kersey | 33/265 |
| 4,823,474 | A * | 4/1989 | Reynolds | 33/265 |
| 5,384,966 | A * | 1/1995 | Gibbs | 33/265 |
| 5,507,272 | A * | 4/1996 | Scantlen | 124/87 |
| 5,509,402 | A * | 4/1996 | Sappington | 124/87 |
| 5,718,215 | A * | 2/1998 | Kenny et al. | 124/87 |
| 6,493,951 | B1 * | 12/2002 | Smith et al. | 33/265 |
| 6,609,306 | B2 * | 8/2003 | Johnson et al. | 33/265 |
| 6,796,039 | B2 * | 9/2004 | Walbrink | 33/265 |
| 7,275,328 | B1 * | 10/2007 | Rager | 33/265 |
| 2003/0110647 | A1 * | 6/2003 | Henry | 33/265 |
| 2005/0183272 | A1 * | 8/2005 | Meadows | 33/265 |

* cited by examiner

*Primary Examiner*—Christopher W Fulton
(74) *Attorney, Agent, or Firm*—John J. Elnitski, Jr.

(57) ABSTRACT

A bow sight mount to be mounted to an archery bow and to receive a sight. The bow sight mount includes a base mount to be mounted to the archery bow. A sight platform mount is attached to the base mount. The sight platform mount being adjustable on the base mount to allow for gross adjustments of the sight platform mount on the base mount. A sight platform attached to the sight platform mount. The sight platform adapted to receive and secure the sight. The sight platform is mounted to the sight platform mount such that the sight platform slides along the sight platform mount for adjustment of the sight. A movement mechanism attached to the sight platform to move the sight platform along the sight platform mount.

19 Claims, 10 Drawing Sheets

ADJUSTABLE ARCHERY BOW SIGHT MOUNT

This application claims benefit of application Ser. No. 60/597,891 filed Dec. 22, 2005.

BACKGROUND

The present invention generally relates to bow sights used on archery bows for sighting of a target. More specifically, the present invention relates to an adjustable mount to be mounted on a bow which allows adjustment of a sight attached to the mount.

There are many bow sight mounts on the market today which are adjustable. The problem with most adjustable bow sight mounts are that they are not easily adjusted during the aiming process on the fly or have a large complicated distance indexing systems for a single pin sight.

It is an object of the present invention to provide a bow sight mount that allows adjustment of a bow sight on the fly for different distances just prior to shooting the bow.

It is another object of the present invention to provide a bow sight that has a distance indexing system which is compact and visible in low light.

SUMMARY OF THE INVENTION

A bow sight mount to be mounted to an archery bow and to receive a sight. The bow sight mount includes a base mount to be mounted to the archery bow. A sight platform mount is attached to the base mount. The sight platform mount being adjustable on the base mount to allow for gross adjustments of the sight platform mount on the base mount. A sight platform attached to the sight platform mount. The sight platform adapted to receive and secure the sight. The sight platform is mounted to the sight platform mount such that the sight platform slides along the sight platform mount for adjustment of the sight. A movement mechanism attached to the sight platform to move the sight platform along the sight platform mount.

DETAILED DESCRIPTION

Figure 1:
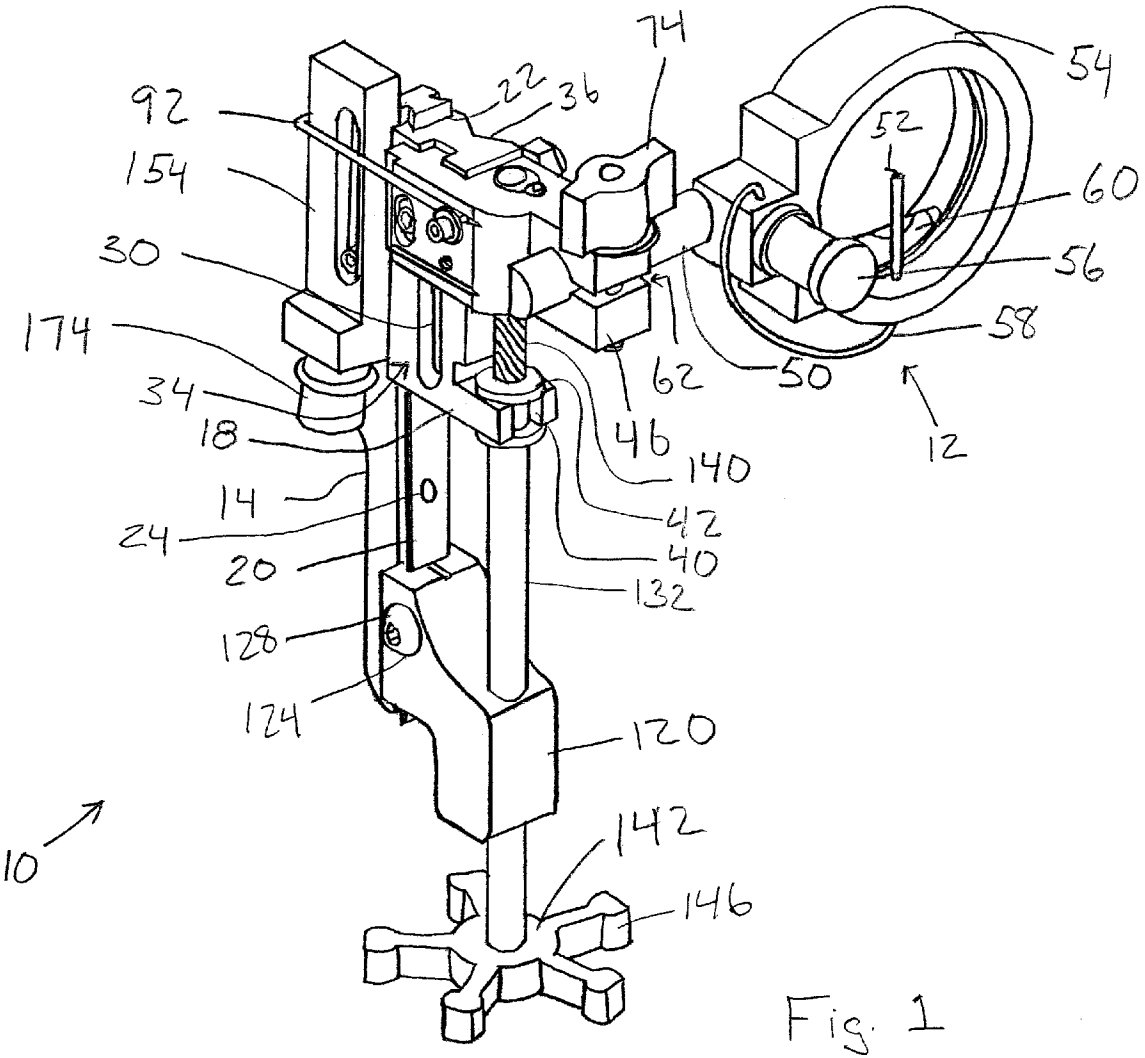
FIG. 1 is a perspective view of a bow sight mount according to the present invention.
Figure 2:
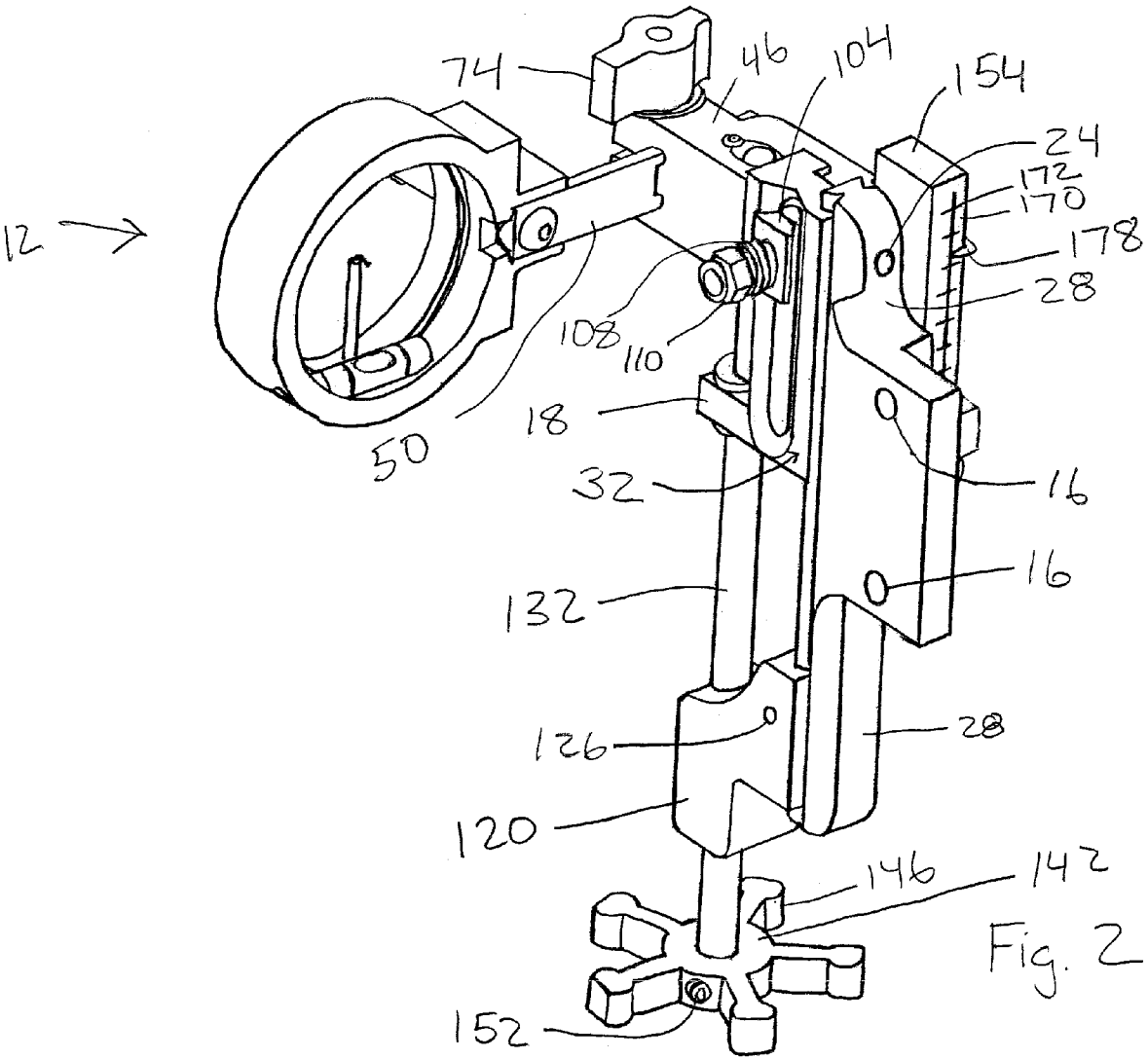
FIG. 2 is a perspective view of a bow sight mount according to the present invention.
Figure 3:
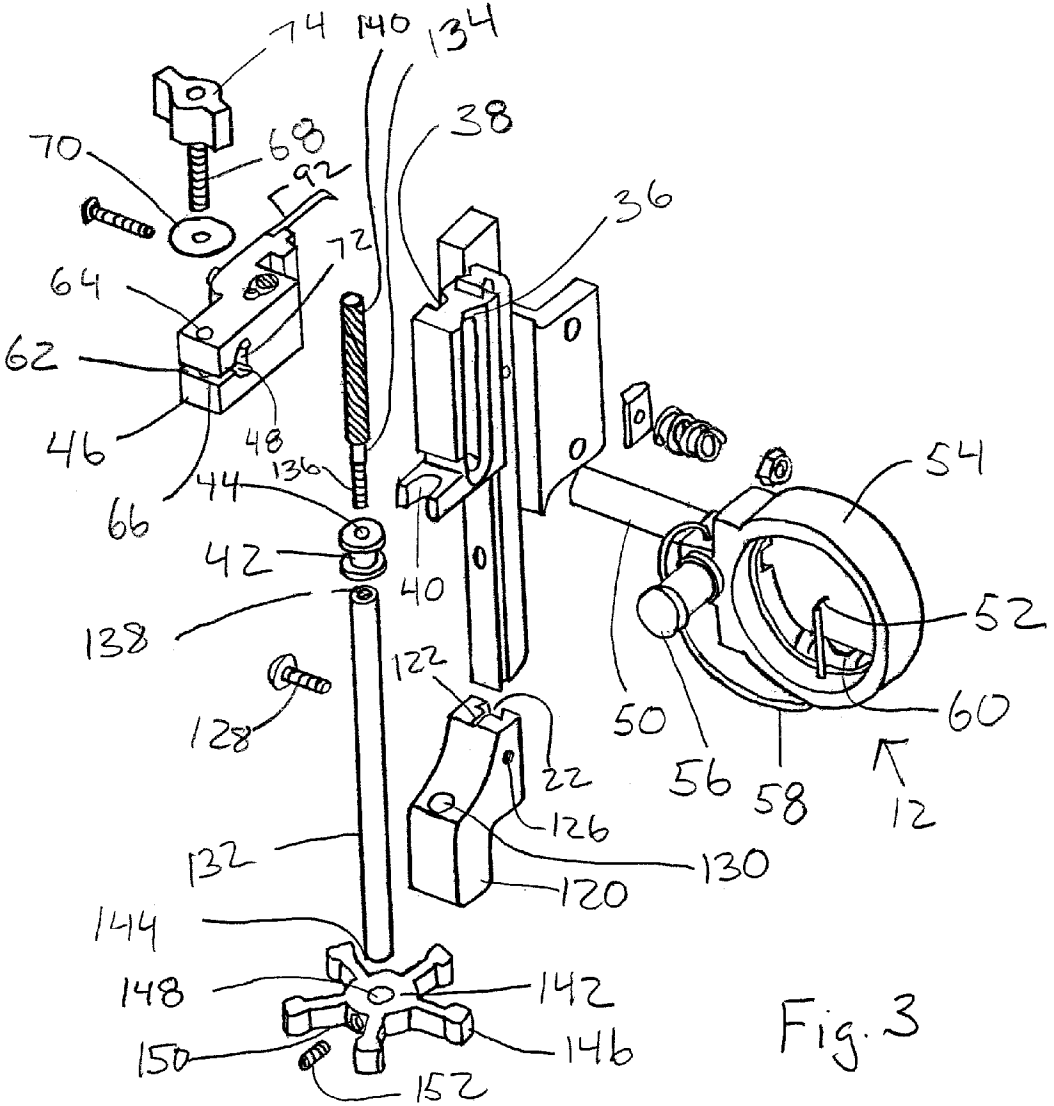
FIG. 3 is an exploded perspective view of a bow sight mount according to the present invention.
Figure 4:
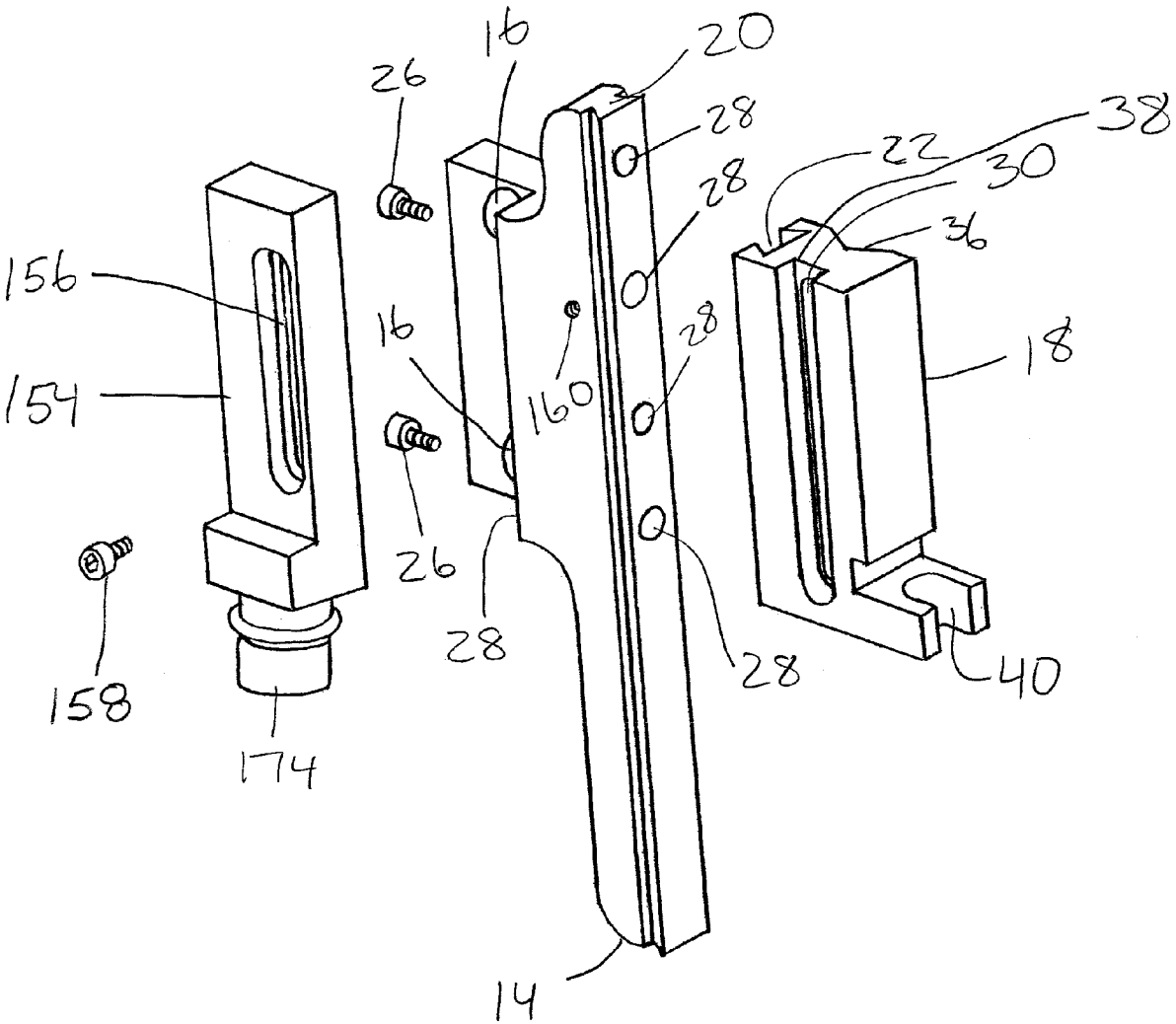
FIG. 4 is an exploded perspective view of a base mount, sight platform mount and distance indexing system of a bow sight mount according to the present invention.
Figure 5:
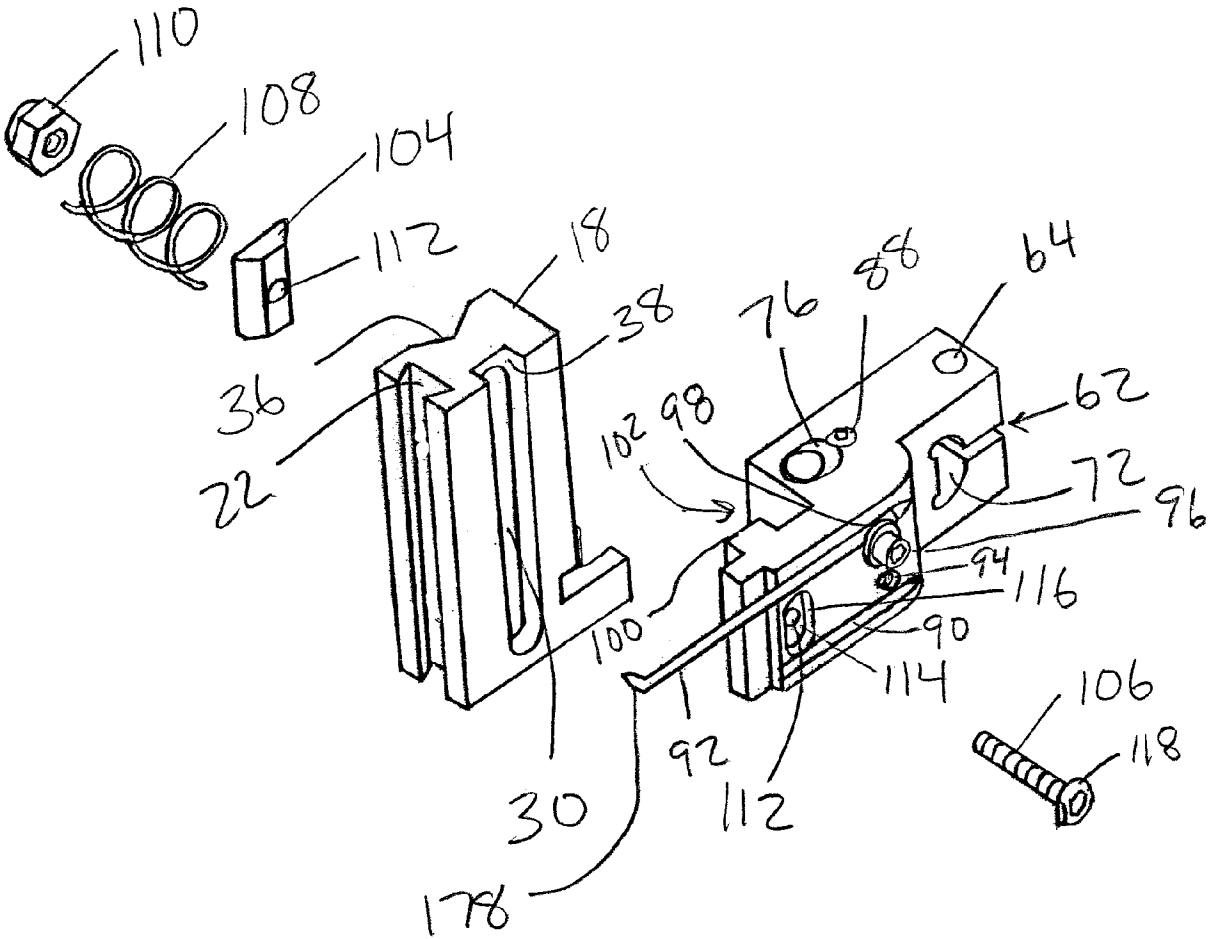
FIG. 5 is an exploded perspective view of a sight platform mount and sight platform of a bow sight mount according to the present invention.
Figure 6:
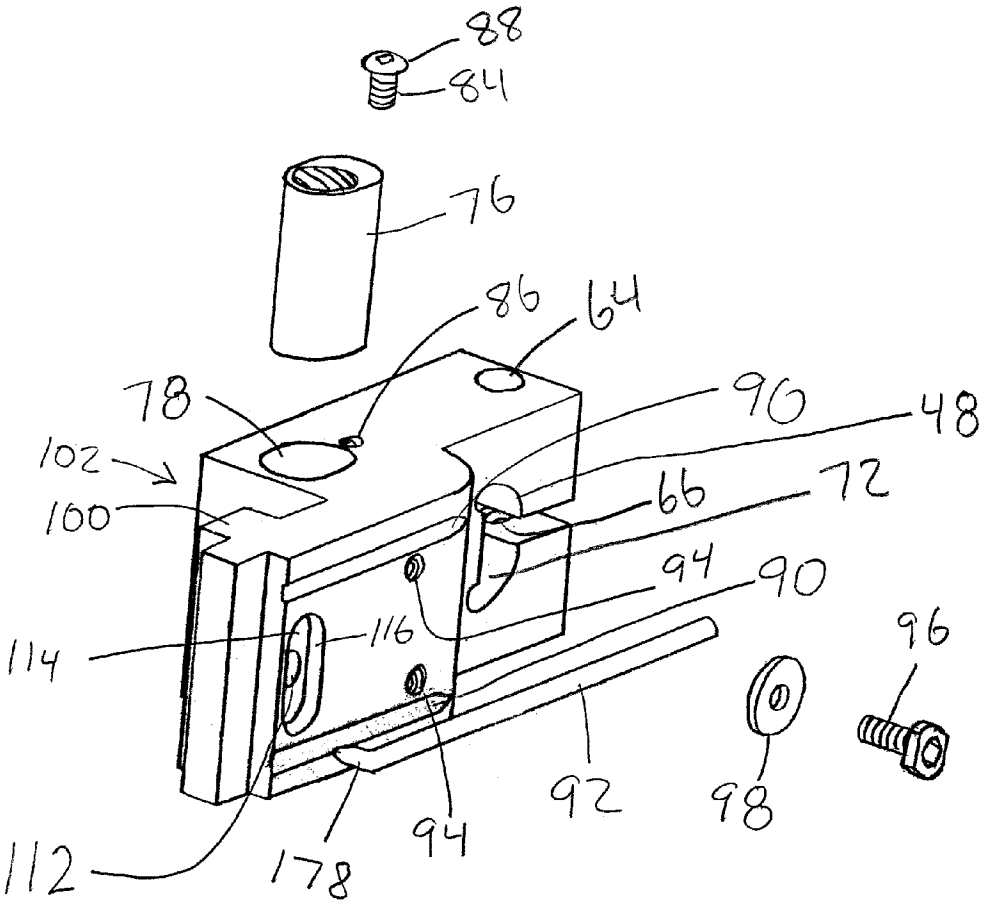
FIG. 6 is an exploded perspective view of a sight platform of a bow sight mount according to the present invention.
Figure 7:
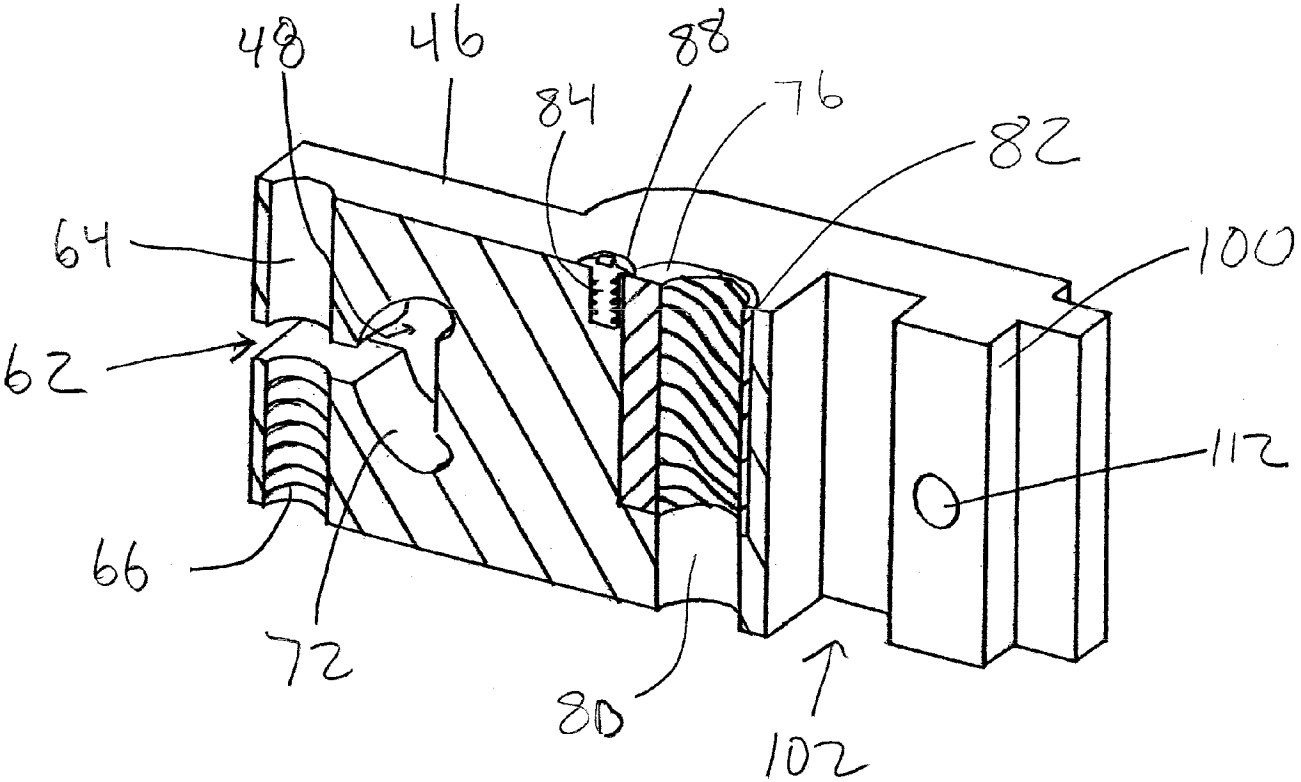
FIG. 7 is an cross-sectional view of a sight platform of a bow sight mount according to the present invention.
Figure 8:
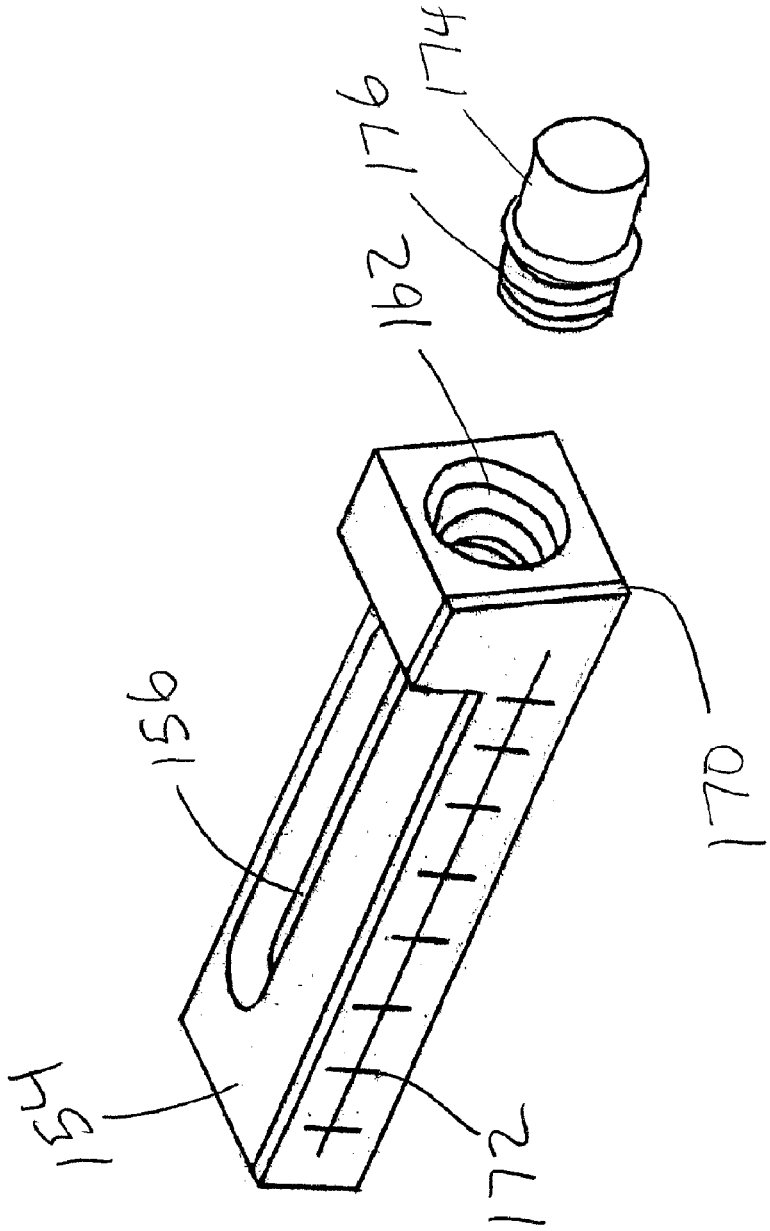
FIG. 8 is a perspective view of a distance indexing system of a bow sight mount according to the present invention.
Figure 9:
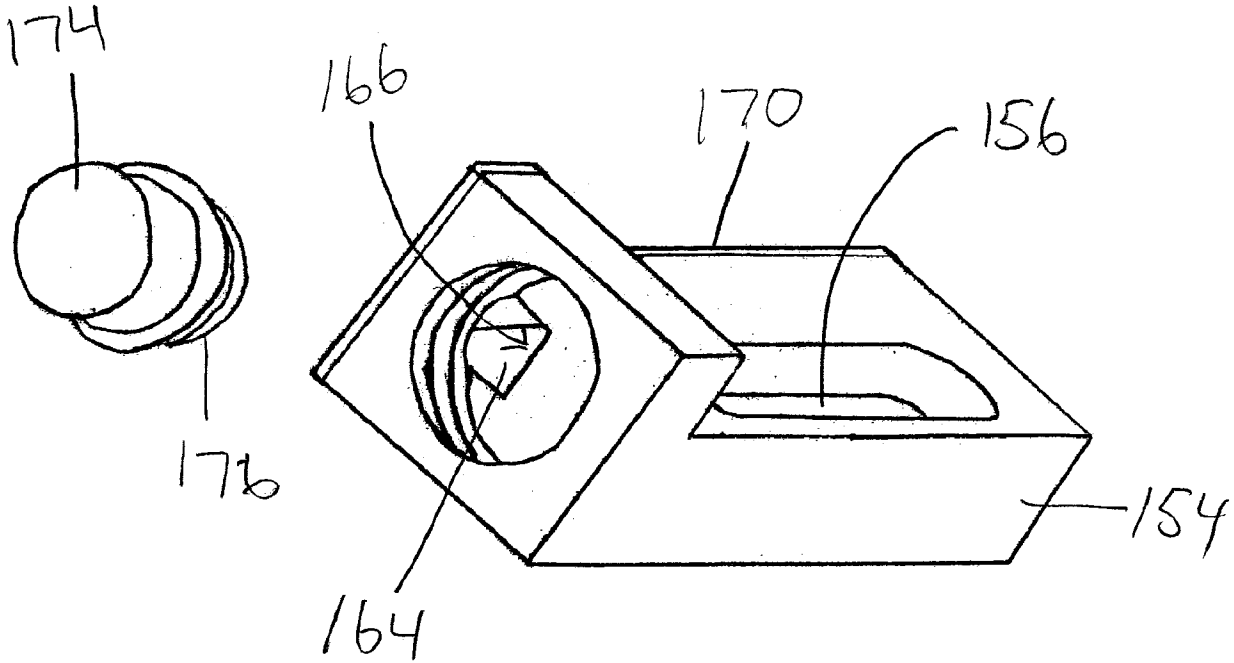
FIG. 9 is a perspective view of a distance indexing system of a bow sight mount according to the present invention.
Figure 10:
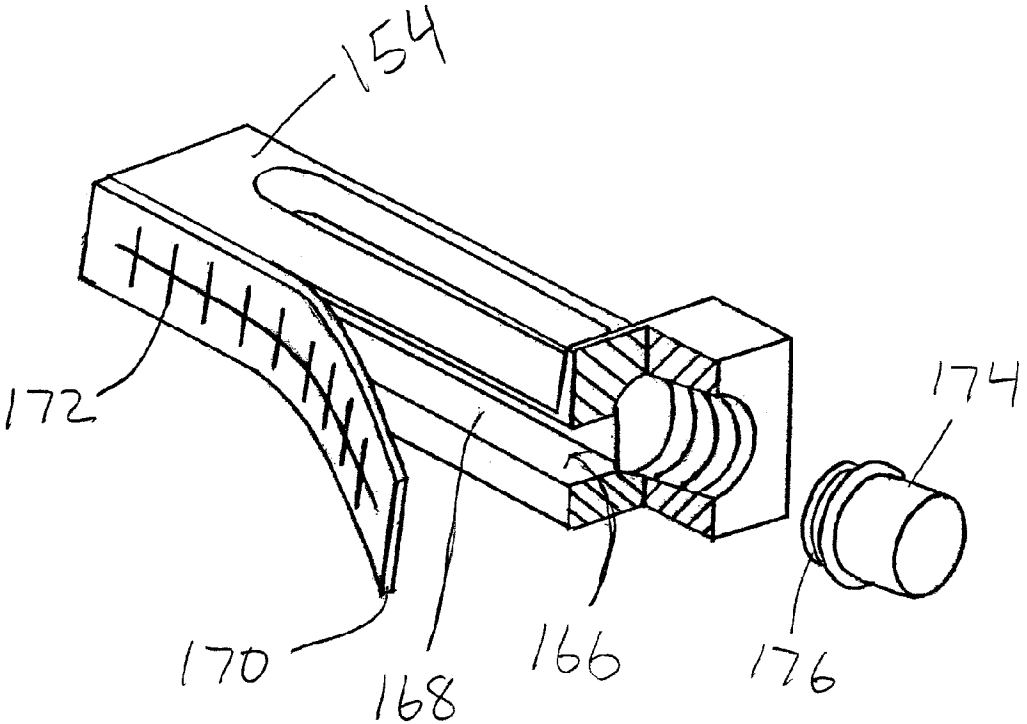
FIG. 10 is a perspective view of a distance indexing system of a bow sight mount according to the present invention.

The present invention is a bow sight mount 10 that is adjustable and has a distance index system for a bow sight 12, as shown in FIGS. 1-10. FIGS. 1-2 show the bow sight mount 10 assembled and ready to mount to an archery bow. FIGS. 1-2 show the sight 12 mounted to the bow sight mount 10. FIG. 3 shows a partial disassembled view of the components of the bow sight mount 10 with the sight 12 removed. The bow sight mount 10 includes a base mount 14, which mounts to the archery bow and serves to support the other components of the bow sight mount 10, as shown in FIGS. 1-4. The base mount 14 includes bow mount holes 16 to be used to secure the base mount 14 to an archery bow.

FIGS. 1-5 show a sight platform mount 18 which mounts to the base mount 14. The base mount 14 includes a dovetailed male section 20 that fits in to a dovetailed female groove 22 of the sight platform mount 18. The sight platform mount 18 slides up and down the base mount 14 along the dovetailed male section 20 for gross adjustment, such the sight 12 will be in the desired location range in relation to the archery bow, when the bow sight mount 10 is attached to an archery bow. The base mount 14 includes a plurality of threaded holes 24 along the dovetailed male section 20 to receive sight platform mount screws 26. The threaded holes 24 run from the dovetailed male section 20 to an outside surface 28. After positioning of the sight platform mount 18 along the dovetailed male section 20 during gross adjustment of the sight platform mount 18, the sight platform mount screws 26 are threaded into the threaded holes 24 of the base mount 14 from the outside surface 28 and against the dovetailed female groove 22 of the sight platform mount 18. The pressure of the sight platform mount screws 26 against the dovetailed female groove 22 of the sight platform mount 18 holds the slight platform mount 18 in place. The sight platform mount 18 includes a slide slot 30. The sight platform mount 18 has a bow side 32 and an outward side 34. On the bow side 32 of the sight platform mount 18, there is a V-shaped groove 36 about the slide slot 30. On the outward side 34 of the sight platform mount 18, there is a square U-shaped groove 38 about the slide slot 30. The sight platform mount 18 includes a U-shaped bushing retainer 40 to receiver a handle bushing 42 with a movement shaft opening 44.

FIGS. 2-3 and 4-6 show a sight platform 46. The sight platform 46 includes a sight arm opening 48 to receive the arm 50 of the sight 12, in order to mount the sight 12. The sight 12 is known in the art and includes at least on pin 52 to align on the target to be shot. The sight 12 is shown as a fiber optic pin 52 within a circular housing 54. The sight 12 includes a light collector 56 which is connected to a fiber optic cable 58 which ends as the pin 52. The housing 54 includes a level 60. The sight arm 50 is D-shaped. The sight arm opening 48 is D-shaped to receive the D-shaped sight arm 50. The D-shape prevents accidental rotation of the sight 12 along the axis of the sight arm 50. The sight arm opening 48 includes a slot 62. The slot 62 includes a slot bolt hole 64 and threaded slot hole 66 to receive a bolt 68. A washer 70 is shown to be used with the bolt 68. The bolt 68 is used to close the distance of the slot 62 when threaded into the threaded slot hole 66. Tightening of the bolt 68 tightens the grip by the inside surface 72 of the sight arm opening 48 about the sight arm 50. The bolt 68 includes a knob 74 to ease tightening of the inside surface 72 of sight arm opening 48 about the sight arm 50.

The sight platform 46 includes threaded insert 76 which slides into an insert hole 78 of the sight platform 46. The bottom 80 of the insert hole 78 is smaller that the top 82 of the insert hole 78 to hold the threaded insert 76 in the insert hole 78. An insert screw 84 that is threaded into an insert screw hole 86 secures the threaded insert 76 in the insert hole 78, when the head 88 of the insert screw 84 contacts the threaded insert 76. The threaded insert 76 includes a precision roll threaded opening from end to end. The sight platform 46 includes two indicator grooves 90 for placement of an indicator 92. Next to each indicator groove 90 is a threaded indicator hole 94 to receive an indicator screw 96. The indicator screw 96 is threaded into the threaded indicator hole 94. An indicator washer 98 placed on the indicator screw 96 is used to clamp the indicator 92 in place. The indicator groove 90 chosen for use will be based on mounting position of the bow sight mount 10 on the bow and final position of the other components of the bow sight mount 10. The sight platform 46 includes a square shaped slide section 100 and a sight platform mount cutout 102 about the square shaped slide section 100. The sight platform includes a V-shaped slide retainer 104, slide screw 106, slide spring 108 and slide nut 110. The square shaped slide section 100 of the sight platform 46 fits into the square U-shaped groove 38 about the slide slot 30 of the sight platform mount 18. The sight platform mount cutout 102 about the square shaped slide section 100 of the a sight platform 46 is shaped such that it fits about the sight platform mount 18, as shown in FIGS. 1-2. The V-shaped slide retainer 104 of the sight platform 46 fits into the V-shaped groove 36 about the slide slot 30 of the sight platform mount 18. The V-shaped slide retainer 104 and the sight platform 46 each include a retainer opening 112 to receive the slide screw 106. The retainer opening 112 in the sight platform 46 is thru an area within the square shaped slide section 100 of the sight platform 46. The sight platform 46 includes a slot shaped depression 114 about the retainer opening 112 on the sight platform 46. The slot shaped depression 114 includes screw retainer walls 116. The head 118 of the slide screw 106 is shaped to lock in place within the screw retainer walls 116, so that a tool is not needed to prevent the slide screw 106 from rotating when placed in the retainer opening 112. The slide screw 106 is placed into the retainer opening 112 at the slot shaped depression 114. The slide screw 106 passes through the slide slot 30 of the sight platform mount 18. The slide screw 106 passes through the retainer opening 112 of the V-shaped slide retainer 104. The slide spring 108 is placed over slide screw 106 as it passes out of the V-shaped slide retainer 104. The slide nut 110 is threaded onto the end of the slide screw 106 just enough to allow the sight platform 46 to move up and down along the slide slot 30 under tension. The more the slide nut 110 is threaded onto the slide screw 106 and pushes against the slide spring 108, the more pressure it will take to move the sight platform 46 up and down along the slide slot 30.

FIGS. 1-3 show a handle support 120 that attaches to the base mount 14. The handle support 120 includes a dovetailed female groove 22 which fits over the dovetailed male section 20 of the base mount 14. The handle support 120 can slide up and down the dovetailed male section 20 of the base mount 14 during gross adjustment of the sight 12. The handle support 120 includes handle support slot 122 in the center of the dovetailed female groove 22 to allow the compression of the dovetailed female groove 22. The handle support 120 includes a groove screw opening 124 and a threaded groove screw hole 126, which are aligned to receive a groove screw 128 and are in the area of the handle support slot 122. The groove screw 128 is inserted into the screw opening 124, passes through the handle support slot 122 and threads into the threaded groove screw hole 126. Tightening of the groove screw 128 into the threaded groove screw hole 126 tightens the dovetailed female groove 22 about the dovetailed male section 20 of the base mount 14, thereby securing the handle support 120 to the base mount 14. The handle support 120 includes a handle shaft opening 130 to receive a handle shaft 132, as shown in FIG. 3. The handle shaft 132 passes through the handle opening 130 of the handle support 120 and threads onto a movement shaft 134. The movement shaft 134 includes a handle end 136 that is threaded and threads into a threaded hole 138 of the handle shaft 132. Before the handle end 136 of the movement shaft 134 is threaded into the handle shaft 132, the handle end 136 is inserted into the movement shaft opening 44 of the handle bushing 42 of the sight platform mount 18. The movement shaft 134 can rotate within the handle bushing 42 and handle bushing 42 provides support for the handle end 136 of the movement shaft 134 and handle shaft 132. The movement shaft 134 includes a slide end 140 that has precision roll threading that threads into the precision roll threading of the threaded insert 76 of the sight platform 46. A handle knob 142 attaches to a knob end 144 of the handle shaft 132. The handle knob 142 includes turning fingers 146, shaft hole 148, threaded set screw hole 150 and set screw 152. The knob end 144 of the handle shaft 132 is inserted into the shaft hole 148 of the handle knob 142. The set screw 152 is threaded into the threaded set screw hole 150 of the handle knob 142 and against the knob end 144 of the handle shaft 132 to secure the handle knob 142 to the handle shaft 132. The turning fingers 146 are elongated as opposed to common extensions about a knob that would be used for gripping. The elongated turning fingers 146 allow turning of the handle shaft 132 by a user only using one finger while aiming an archery bow with the present invention. Turning the handle knob 142, rotates the precision roll threading of the movement shaft 134 and forces the sight platform 46 to slide up and down the slide slot 30.

FIGS. 1-4 and 8-10 show a distance indexing module 154 which mounts to the base mount 14. The distance indexing module 154 includes an open slot 156. A module screw 158 is inserted into the open slot 156 of the distance indexing module 154 and threaded into a threaded module hole 160 of the base mount 14. The module screw 158 secures the distance indexing module 154 to the base mount 14. The open slot 156 of the distance indexing module 154 allows for adjustment of the positioning of the distance indexing module 154 on the base mount 14 during gross adjustment of the sight 12. The distance indexing module 154 includes a threaded light hole 162. The threaded light hole 162 leads to a light chamber opening 164. Beyond the light chamber opening 164 is a light chamber 166. The light chamber 166 is formed by a three sided channel 168 and a indicator surface 170. The indicator surface 170 is a translucent layer of material that includes indexing marks 172 to indicate distances. The distance indexing module 154 includes a light source 174 which has a threaded end 176 and threads into the threaded light hole 162. Light emanates from the light source 174 and into the light chamber 166 by way of the light chamber opening 164. The translucent material of the indicator surface 170 allows the light to illuminate the indicator surface 170. The distance indexing module 154 is positioned such that the indicator 92 from the sight platform 46 aligns and moves along the indicator surface 170 due to movement of the sight platform 46. The indicator 92 is showed with a pointed curved end 178 to correspond with the indexing marks 172 on the indicator surface 170.

The user mounts the bow sight mount 10 on an archery bow in the most convenient location, keeping in mind the range of gross adjustment of the components of the bow sight mount 10. The bow sight mount 10 is mounted by using the bow mount holes 16 of the base mount 14 and appropriate fasteners to secure the base mount 14 to the archery bow. After the bow sight mount 10 is secured to the archery bow, gross adjustments of the sight platform mount 18 and handle support 120 are made to place the sight 12 in the proper position. The sight platform mount 18 is secured to base mount 14 such that movement of the sight platform 46 up and down the slide slot 30 is within the desired operating range of movement of the sight 12. The handle support 120 is secured to the base mount 14 at the proper distance from the sight platform mount 18 based on the handle shaft 132 and movement shaft 134 dimensions. The sight 12 is adjusted in the sight platform 46 based on desired preferences of the user. The indicator 92 is mounted in one of the indicator grooves 90. The indicator surface 170 has indexing marks 172 by either being indexed by the user or being pre-marked. The user then sights in the archery bow. During sight in, the user moves the sight platform 46 up and down and references the indexing marks 172 on the indicator surface 170 to determine where an arrow will hit a target at a certain distance. The user can later use this information to adjust the sight platform 46 up and down depending on distance from the target in order to properly position the sight 12 on a target at that particular distance.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A bow sight mount adapted to be mounted to an archery bow and adapted to receive a sight which allows movement of the sight by a user, comprising:

a base mount adapted to be mounted to the archery bow, said base mount including mounting holes adapted for mounting said base mount to the archery bow;

a sight platform mount attached to said base mount, said sight platform mount being adjustable on said base mount to allow for gross adjustments of said sight platform mount up and down on said base mount to adaptively account for proper positioning of a sight attached to said bow sight mount along the archery bow during mounting of said bow sight mount to the archery bow;

a sight platform attached to said sight platform mount, said sight platform adapted to receive and secure the sight, said sight platform mounted to said sight platform mount such that said sight platform slides up and down along said sight platform mount for adjustment of the sight during use of the archery bow;

a movement mechanism attached to said sight platform to move said sight platform along said sight platform mount, wherein movement of the sight is performed by the user activating said movement mechanism.

2. The bow sight mount of claim 1, wherein said base mount and said sight platform mount each include a dovetail section that correspond to each other such that said base mount and said sight platform mount engage each other and so that said sight platform mount can slide up and down said base mount for gross adjustment.

3. The bow sight mount of claim 2, wherein said dovetail section of said base mount includes threaded holes which lead to said dovetail section of said sight platform mount and wherein sight platform mount screws are screwed into said threaded holes of said base mount to secure said sight platform mount in place.

4. A bow sight mount adapted to be mounted to an archery bow and adapted to receive a sight which allows movement of the sight by a user, comprising:

a base mount adapted to be mounted to the archery bow;

a sight platform mount attached to said base mount, said sight platform mount being adjustable on said base mount to allow for gross adjustments of said sight platform mount on said base mount to adaptively account for proper positioning of a sight attached to said bow sight mount along the archery bow during mounting of said bow sight mount to the archery bow;

a sight platform attached to said sight platform mount, said sight platform adapted to receive and secure the sight, said sight platform mounted to said sight platform mount such that said sight platform slides along said sight platform mount for adjustment of the sight during use of the archery bow;

a movement mechanism attached to said sight platform to move said sight platform along said sight platform mount, wherein movement of the sight is performed by the user activating said movement mechanism; and said sight platform mount includes a slide slot between a bow side surface and an outward surface of said sight platform mount, wherein said sight platform includes a slide screw which extends out from said sight platform and inserts from said outward surface and into said side slot, wherein said sight platform includes a slide retainer which mounts onto said slide screw from said bow side surface and mounts against said bow side surface to secure said sight platform to said sight platform mount, wherein said sight platform includes a spring which slides on said slide screw after said slide retainer and a nut which threads onto said slide screw to secure said slide retainer against said sight platform mount and where said spring acts as a tensioner to allow sliding of said sight platform along said slide slot under tension.

5. The bow sight mount of claim 4, wherein said sight platform, said slide retainer and areas about said slide slot are all correspondingly grooved to each other to allow secure movement of said slide retainer and said sight platform along said slide slot.

6. The bow sight mount of claim 4, wherein said movement mechanism includes a threaded shaft, where said threaded shaft is fixed to said bow sight mount such that said threaded shaft can only rotate about a point, wherein said sight platform includes a threaded shaft hole to receive said threaded shaft and wherein said movement mechanism includes a handle to rotate said threaded shaft such that rotation of said threaded shaft in said threaded shaft hole moves said sight platform.

7. The bow sight mount of claim 6, wherein said movement mechanism includes a handle support mounted to said base mount to support said handle while allowing rotation of said handle and wherein said handle support being adjustable along said base mount to allow for gross adjustments of said handle support on said base mount in relation to said sight platform mount and said sight platform in order to adaptively account for proper positioning of a sight attached said bow sight mount along the archery bow during mounting of the bow sight mount to the archery bow.

8. The bow sight mount of claim 7, wherein said handle includes a handle shaft connected to said threaded shaft of said movement mechanism.

9. The bow sight mount of claim 8, wherein said sight platform includes a retainer and a bushing in said retainer and wherein said bushing includes a handle opening to receive a combination of said handle shaft and said threaded shaft to retain said threaded shaft in position.

10. The bow sight mount of claim 8, wherein said handle shaft includes a knob, said knob including elongated fingers to allow finger tip turning of the knob.

11. The bow sight mount of claim 7, wherein said base mount and said sight platform each include a dovetail section that correspond to each other such that said base mount and said sight platform engage each other and so that said sight platform can slide up and down said base mount for gross adjustment; and wherein said handle support includes a dovetail section that corresponds to said dovetail section of said base mount so that said handle support and said base mount engage each other and so that said handle support can slide up and down said base mount for gross adjustment.

12. The bow sight mount of claim 11, wherein said dovetail section of said base mount includes threaded holes which lead to said dovetail section of said sight platform mount and wherein sight platform mount screws are screwed into said threaded holes of said base mount to secure said sight platform mount in place.

13. A bow sight mount adapted to be mounted to an archery bow and adapted to receive a sight which allows movement of the sight by a user, comprising:

a base mount adapted to be mounted to the archery bow;

a sight platform mount attached to said base mount, said sight platform mount being adjustable on said base mount to allow for gross adjustments of said sight platform mount on said base mount to adaptively account for proper positioning of a sight attached to said bow sight mount along the archery bow during mounting of said bow sight mount to the archery bow;

a sight platform attached to said sight platform mount, said sight platform adapted to receive and secure the sight, said sight platform mounted to said sight platform mount such that said sight platform slides along said sight platform mount for adjustment of the sight during use of the archery bow;

a movement mechanism attached to said sight platform to move said sight platform along said sight platform mount, wherein movement of the sight is performed by the user activating said movement mechanism; and a distance indexing system mounted to said base mount, said distance indexing system comprising:

a distance indexing module mounted along said slight platform, said distance indexing module having a indicator surface which can be indexed to indicates sight distances; and a distance indicator mounted to said sight platform that moves with said sight platform and extends along said indicator surface of said distance indexing module to indicate sight distances.

14. The bow sight mount of claim 13, wherein said indicator surface is translucent and further including a light source within said distance marker module which illuminates said indicator surface.

15. The bow sight mount of claim 14, wherein said distance indexing module includes a light chamber and said light source screws into an opening in said distance indexing module which leads to said light chamber.

16. A bow sight mount adapted to be mounted to an archery bow and adapted to receive a sight which allows movement of the sight by a user, comprising:

a base mount adapted to be mounted to the archery bow;

a sight platform attached to said base mount, said sight platform adapted to receive and secure the sight, said sight platform mounted to said base mount such that said sight platform slides along said base mount for adjustment of the sight during use of the archery bow, said base mount including a slide slot between a bow side surface and an outward surface of said base mount, said sight platform including a slide screw which extends out from said sight platform and inserts into said side slot from said outward surface, said sight platform including a slide retainer which mounts onto said slide screw from said bow side surface and mounts against said bow side surface to secure said sight platform to said base mount, wherein said sight platform includes a spring which slides on said slide screw after said slide retainer and a nut which threads onto said slide screw to secure said slide retainer against said base mount in a clamping action and where said spring acts as a tensioner to allow sliding of said sight platform along said slide slot under tension to be adjustable; and a movement mechanism attached to said sight platform to move said sight platform along said base mount, wherein movement of the sight is performed by the user activating said movement mechanism.

17. The bow sight mount of claim 16, wherein said sight platform, said slide retainer and areas about said slide slot are all correspondingly grooved to each other to allow secure movement of said slide retainer and said sight platform along said slide slot.

18. A bow sight mount adapted to be mounted to an archery bow and adapted to receive a sight which allows movement of the sight by a user, comprising:

a base mount adapted to be mounted to the archery bow;

a sight platform attached to said base mount, said sight platform adapted to receive and secure the sight, said sight platform mounted to said base mount such that said sight platform slides along said base mount for adjustment of the sight during use of the archery bow; and a distance indexing system mounted to said base mount, said distance indexing system including a distance indexing module mounted along said slight platform, said distance indexing module having a indicator surface which can be indexed to indicate sight distances; said distance indexing system including a distance indicator that moves in coordination with said sight platform and extends along said indicator surface of said distance indexing module to indicate sight distances;

said indicator surface is translucent and further including a light source within said distance indexing module and behind said translucent indicator surface to illuminate said indicator surface.

19. The bow sight mount of claim 18, wherein said distance indexing module includes a light chamber and said light source screws into an opening in said distance indexing module which leads to said light chamber.

* * * * *